US009617823B2

(12) United States Patent
George et al.

(10) Patent No.: US 9,617,823 B2
(45) Date of Patent: Apr. 11, 2017

(54) AXIALLY COMPRESSED AND RADIALLY PRESSED SEAL

(71) Applicant: SCHLUMBERGER TECHNOLOGY CORPORATION, Sugar Land, TX (US)

(72) Inventors: Grant George, Calgary (CA); Shane Sargent, Calgary (CA); Curtis Ring, Calgary (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 285 days.

(21) Appl. No.: 14/345,712

(22) PCT Filed: Sep. 19, 2012

(86) PCT No.: PCT/CA2012/050655

§ 371 (c)(1),
(2) Date: Mar. 19, 2014

(87) PCT Pub. No.: WO2013/040709

PCT Pub. Date: Mar. 28, 2013

(65) Prior Publication Data

US 2015/0300122 A1 Oct. 22, 2015

Related U.S. Application Data

(60) Provisional application No. 61/573,173, filed on Sep. 19, 2011.

(51) Int. Cl.
*E21B 23/06* (2006.01)
*E21B 33/126* (2006.01)
(Continued)

(52) U.S. Cl.
CPC ..... *E21B 33/1285* (2013.01); *E21B 23/06* (2013.01); *E21B 33/128* (2013.01); *E21B 34/02* (2013.01)

(58) Field of Classification Search
CPC .... E21B 17/1042; E21B 23/06; E21B 33/126; E21B 33/128; E21B 33/1285; F16J 15/028
See application file for complete search history.

(56) References Cited

U.S. PATENT DOCUMENTS 2,447,827 A 8/1948 Turechek
2,669,305 A 2/1954 Condra
(Continued)

FOREIGN PATENT DOCUMENTS

GB 2296520 A 7/1996
WO 2010112810 A2 10/2010
(Continued)

*Primary Examiner* — Cathleen Hutchins
(74) *Attorney, Agent, or Firm* — Jeffery R. Peterson

(57) ABSTRACT

An apparatus and method for sealing against a bore in a soil formation. The apparatus comprises an elongate central member having a resilient tubular seal member extending between first and second ends therearound, a longitudinally moveable plunger surrounding the central member having a first wedge engagable upon the first end of the seal member and a backing ring engaging upon the second end of the seal member. The plunger is axially movable along the central member to compress the seal member between plunger and the packing ring and to press the first end of the seal member in a radially outward direction. The method comprises a locating the apparatus at a desired location and axially moving the plunger towards a corresponding backing ring so as to compress the seal member between plunger and the packing ring and to press the seal member in a radially outward direction.

16 Claims, 5 Drawing Sheets

(51) Int. Cl.
*E21B 33/128* (2006.01)
*E21B 34/02* (2006.01)

(56) References Cited

U.S. PATENT DOCUMENTS

| | | | | |
|---|---|---|---|---|
| 3,109,493 | A * | 11/1963 | Carter | E21B 33/12 277/337 |
| 3,525,393 | A * | 8/1970 | Cobbs | E21B 33/128 166/187 |
| 3,561,527 | A * | 2/1971 | Nelson | E21B 33/043 285/123.2 |
| 3,970,145 | A | 7/1976 | Boyd | |
| 4,368,911 | A * | 1/1983 | Pringle | E21B 23/01 166/98 |
| 5,425,418 | A | 6/1995 | Arizmendi et al. | |
| 5,526,884 | A | 6/1996 | Lembcke | |
| 5,603,511 | A | 2/1997 | Keyser et al. | |
| 5,692,564 | A | 12/1997 | Brooks | |
| 6,302,208 | B1 | 10/2001 | Walker et al. | |
| 6,443,458 | B1 * | 9/2002 | Jansch | G01M 3/022 277/335 |
| 6,474,419 | B2 | 11/2002 | Maier et al. | |
| 6,634,429 | B2 | 10/2003 | Henderson et al. | |
| 6,725,934 | B2 | 4/2004 | Coronado et al. | |
| 6,782,948 | B2 | 8/2004 | Echols et al. | |
| 6,962,215 | B2 | 11/2005 | Curtis et al. | |
| 7,520,333 | B2 | 4/2009 | Turner et al. | |
| 7,814,981 | B2 | 10/2010 | Marcu | |
| 7,823,637 | B2 | 11/2010 | Corbett et al. | |
| 7,909,108 | B2 | 3/2011 | Swor et al. | |
| 8,215,411 | B2 | 7/2012 | Flores et al. | |
| 8,272,443 | B2 | 9/2012 | Watson et al. | |
| 8,282,365 | B2 | 10/2012 | Obrejanu | |
| 8,307,902 | B2 | 11/2012 | Telfer | |
| 8,403,068 | B2 | 3/2013 | Robison et al. | |
| 2009/0065194 | A1 | 3/2009 | Frazier | |
| 2010/0101807 | A1 | 4/2010 | Greenlee et al. | |
| 2011/0061875 | A1 | 3/2011 | Tips et al. | |
| 2011/0174493 | A1 | 7/2011 | Clem | |
| 2012/0067595 | A1 | 3/2012 | Noske et al. | |
| 2012/0090847 | A1 | 4/2012 | Getzlaf et al. | |
| 2012/0097398 | A1 | 4/2012 | Ravensbergen et al. | |
| 2012/0152550 | A1 | 6/2012 | East, Jr. | |
| 2012/0292032 | A1 | 11/2012 | Themig et al. | |
| 2012/0305265 | A1 | 12/2012 | Garcia et al. | |
| 2012/0312557 | A1 | 12/2012 | King | |
| 2013/0025868 | A1 | 1/2013 | Smith et al. | |
| 2013/0068451 | A1 | 3/2013 | Getzlaf et al. | |
| 2013/0092400 | A1 | 4/2013 | Stewart et al. | |
| 2013/0161017 | A1 | 6/2013 | King | |
| 2013/0168090 | A1 | 7/2013 | Themig et al. | |
| 2013/0175040 | A1 | 7/2013 | Madero et al. | |
| 2013/0186644 | A1 | 7/2013 | Smith et al. | |
| 2013/0206402 | A1 | 8/2013 | Coon | |
| 2013/0220603 | A1 | 8/2013 | Robison et al. | |
| 2013/0233564 | A1 | 9/2013 | Pacey | |
| 2013/0333883 | A1 | 12/2013 | Ehtesham et al. | |

FOREIGN PATENT DOCUMENTS

| | | | |
|---|---|---|---|
| WO | 2010124371 | A1 | 11/2010 |
| WO | 2011058325 | A2 | 5/2011 |
| WO | 2012045165 | A1 | 4/2012 |
| WO | 2012051705 | A1 | 4/2012 |
| WO | 2012083047 | A2 | 6/2012 |
| WO | 2012107730 | A2 | 8/2012 |
| WO | 2013028385 | A2 | 2/2013 |
| WO | 2013028801 | A1 | 2/2013 |
| WO | 2013055516 | A1 | 4/2013 |
| WO | 2012051705 | A9 | 5/2013 |
| WO | 2013150304 | A2 | 10/2013 |

* cited by examiner

AXIALLY COMPRESSED AND RADIALLY PRESSED SEAL

BACKGROUND OF THE INVENTION

1. Field of Invention

The present invention relates to hydrocarbon well control in general and in particular method and apparatus for sealing an open well bore.

2. Description of Related Art

In hydrocarbon production, it is frequently desired to seal or isolate one zone of an oil well from an adjacent zone. In such situations, a sealing element is frequently used to seal and isolate the production string to the main bore or to seal adjacent zones from each other. Such sealing elements may be components of a production packer, an open hole production packer, seal adapter, pressure chamber seal adapter (with charged high pressure chamber on board), a liner hanger packer, a full bore liner top packer, a straddle type stimulation tool, a hybrid type stimulation tools (hydraulic and mechanical packer), a element made from swellable rubber compounds, an open hole seal or a cased hole seal all of which may be mechanically, hydraulically, hydrostatically or pressure chamber operated. Existing sealing elements may be of an open well or a sleeved well type. Such sealing elements may also be utilized to seal the well bore during completion, hydraulic fracturing or reworking procedures. With open well sealing elements, the sealing element is required to engage upon and form a seal with the bare rock or soil wall or formation of the well bore. Difficulties with such open well sealing elements are known to exist.

Conventional sealing elements may include either a swellable or an inflatable sealing element to seal against the bore wall. Such conventional sealing elements have had difficulties achieving a proper sealed between the open bore and a sealing element. Such difficulties have resulted from several factors. One such factor is direction of the expansion of the sealing element. In particular with swellable or inflatable sealing elements, the center of the sealing element tends to racially expand to a greater amount than the edge portions thereof. This difference in swell or expansion of the sealing element provides an angular or tapered exterior surface of the sealing element that may permit a portion of the working fluid within the well bore to engage upon and exert a radially inward pressure upon the sealing element. This radially inward pressure upon the sealing element may be sufficient, at high well pressures to displace the sealing element inwards so as to create or expand a gap between the sealing element and the well bore wall, thereby compromising the seal provided by the sealing element. It will be appreciated that higher pressures, such as experienced during hydraulic fracturing, or facing procedures further exacerbates this problem.

Additional factors which have made conventional sealing elements less useful, is the difficulties with inserting the sealing element into the desired location prior to expanding or otherwise activating the sealing element. Many conventional sealing elements includes a longitudinally movable actuator or driver acting upon the sealing element to radially expand it. During insertion, the longitudinally moving actuator may be prone to hanging up or otherwise being frictionally engaged upon the wall of the well bore. Such friction or hang-up may require the sealing element to have a larger insertion force applied thereto. However, such greater insertion force may also inadvertently actuate or expand the sealing element due to longitudinal movement of the actuator which is gripped by the well bore relative to the remainder of the sealing element. Additionally, it will be appreciated that a sufficiently high enough actuation force must be applied to the sealing element to prevent the hydraulic pressure in the well bore from forcing its way therepast. Previous solutions to inadvertent actuation of the sealing element has been to provide a shear pin between the longitudinal movable actuator and the remainder of the device. Such shear pins must have a preselected shear force. Difficulties have existed in selecting such a shear force to be high enough as to prevent inadvertent actuation as well as to be low enough to still permit actuation of the sealing element.

SUMMARY OF THE INVENTION

According to a first embodiment of the present invention there is disclosed an apparatus for sealing against a bore in a soil formation. The apparatus comprises an elongate central member having a resilient tubular seal member extending between first and second ends therearound. The apparatus further including a longitudinally moveable plunger surrounding the central member and having a first wedge engagable upon the first end of the seal member and a backing ring engaging upon the second end of the seal member. The plunger being axially movable along the central member to compress the seal member between plunger and the packing ring and to press the first end of the seal member in a radially outward direction.

The plunger may be movable along the elongate member by an actuator. The actuator may comprise a piston. The piston may be co-formed with the plunger. The piston may annularly surround the central member. The piston may be actuated by a fluid supplied from an interior of the central member. The seal member may include an inelastic ring disposed at the first end thereof corresponding to the plunger.

The inelastic ring may be formed of metal. The inelastic ring may be formed of a plurality of segmented fingers. The plurality of segmented fingers may include at least one expandable spanning member spanning therebetween. The at least one expandable spanning member may comprise a radially expandable retaining ring. The at least one expandable spanning member may comprises at least one flange extending from each finger, adapted to overly an adjacent finger.

The inelastic ring may include an angled leading surface corresponding to the first wedge of the plunger. The inelastic ring may radially inwardly bear against the central member. The inelastic ring may be selectably disengagable from the central member by the plunger wedging therebetween. The inelastic ring may be frangibley connected to the plunger. The inelastic ring may be frangibley connected to the plunger by shear pins.

The apparatus may further comprise first and second seal members being disposed in opposed directions from each other having the backing ring disposed therebetween. The apparatus may further include a check valve extending through the backing ring to relieve pressure between the first and second seal members and between the backing ring and the bore.

According to a further embodiment of the present invention there is disclosed a method of sealing a pipe against a bore in a soil formation. The method comprises a locating a resilient tubular seal member extending between first and second ends around the pipe at a desired location in the soil formation. Axially moving a plunger surrounding the central member towards a corresponding backing ring with a seal member therebetween so as to compress the seal member between plunger and the packing ring and to press the first end of the seal member in a radially outward direction.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
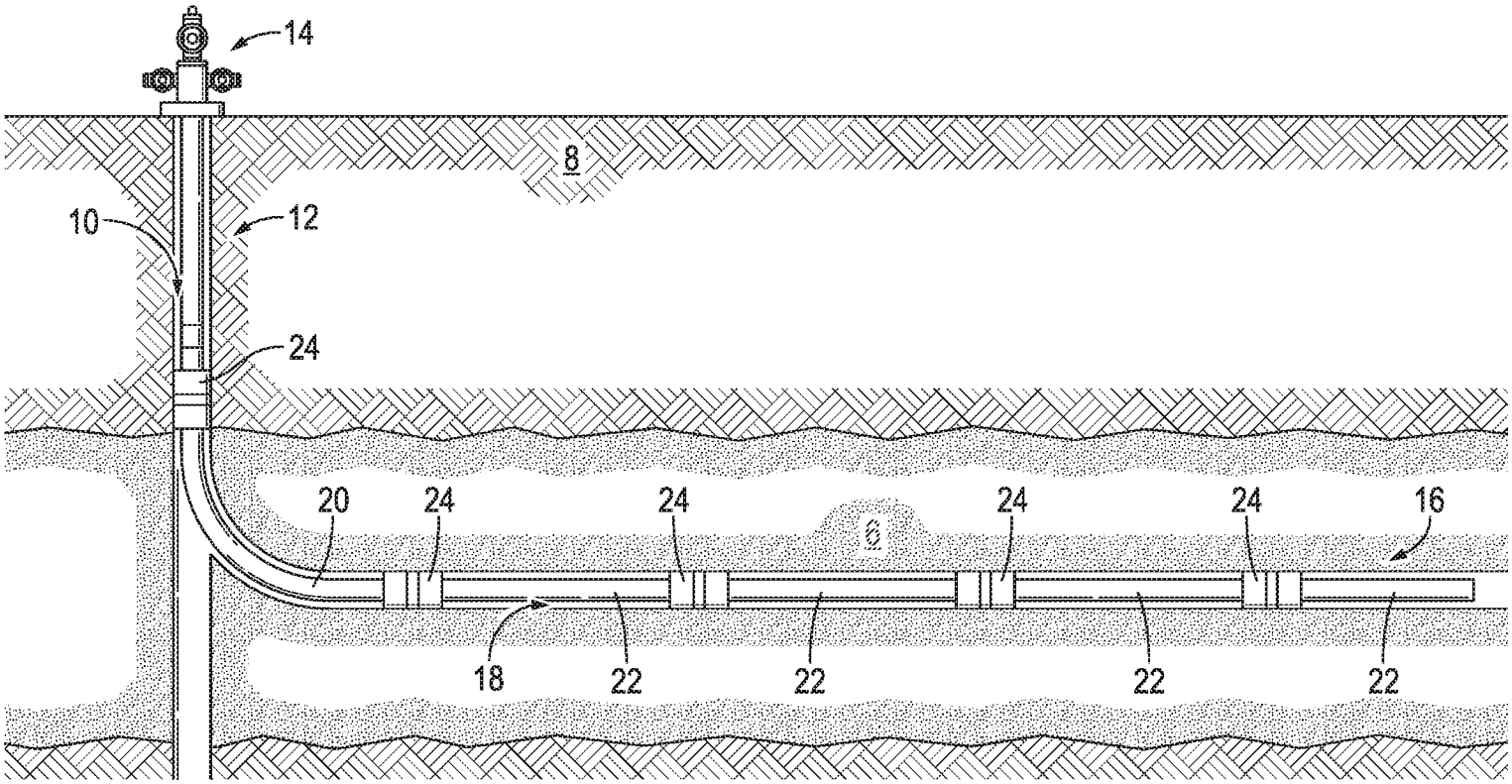
FIG. 1 is a cross-sectional view of a wellbore having a plurality of sealing elements according to a first embodiment of the present invention located therealong.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the liner 20 is of the hydrocarbon well is formed of a plurality of alternating liner or casing 22 sections separated from each other by sealing elements 24 according to a first embodiment of the present invention. As illustrated, the well bore may include one or more horizontal bores 18 from the vertical section wherein the liner 22 is located may be located within a desired horizontal bore 18. The sealing elements are adapted to engage the well bore and seal adjacent sections of liner 22 from each other so as to permit production or completion activities to be performed on individual sections of the well bore. Optionally a sealing element 24 may be located within the vertical section 12 to isolate the desired horizontal section from the remainder of the well bore or to provide a liner hanger to suspend the liner 22 and sealing elements 24 within the desired horizontal bore 18. In operation, between 5 and 80 sealing elements may be utilized within a wellbore to isolate zones between each although it will be appreciated that other quantities may be useful as well.

Figure 2:
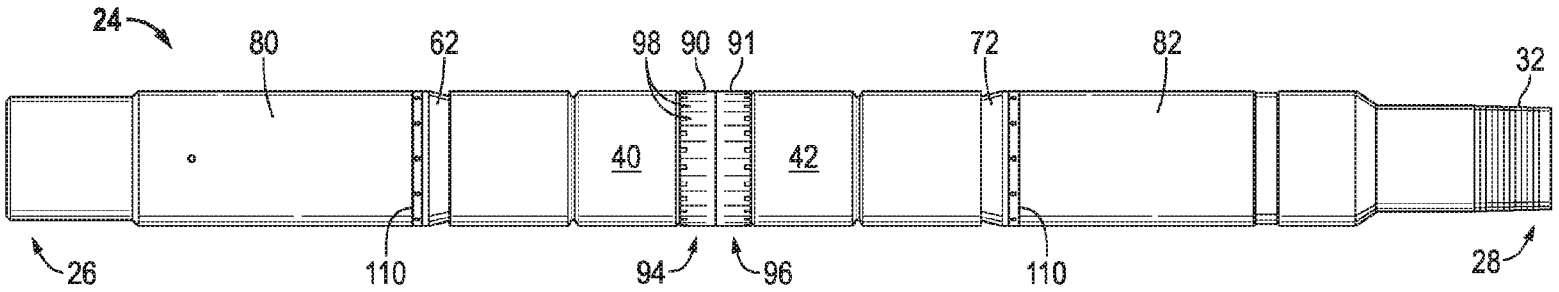
FIG. 2 is a perspective view of one of the sealing elements of FIG. 1.
Figure 3:
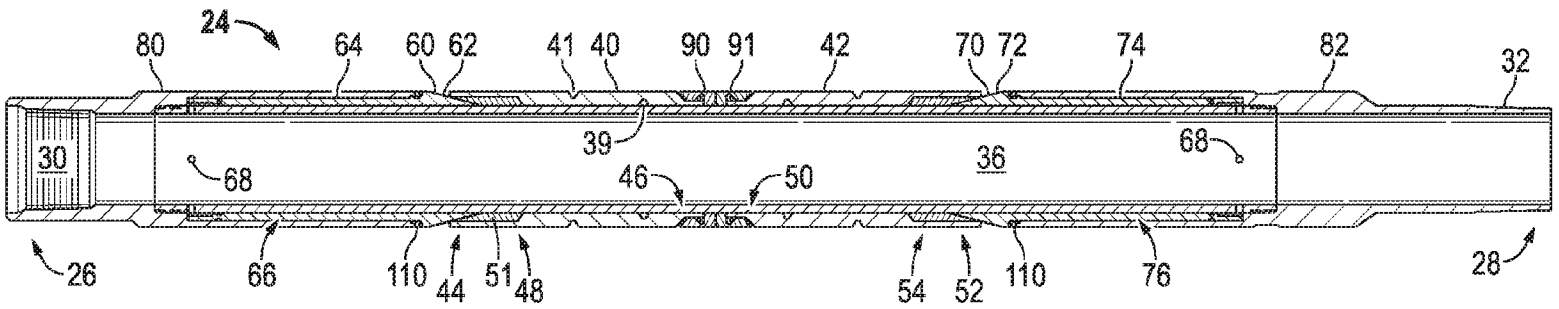
FIG. 3 is a longitudinal cross-sectional view of the sealing element of FIG. 2 as taken along the line 3-3 in a first or retracted position.
Figure 4:
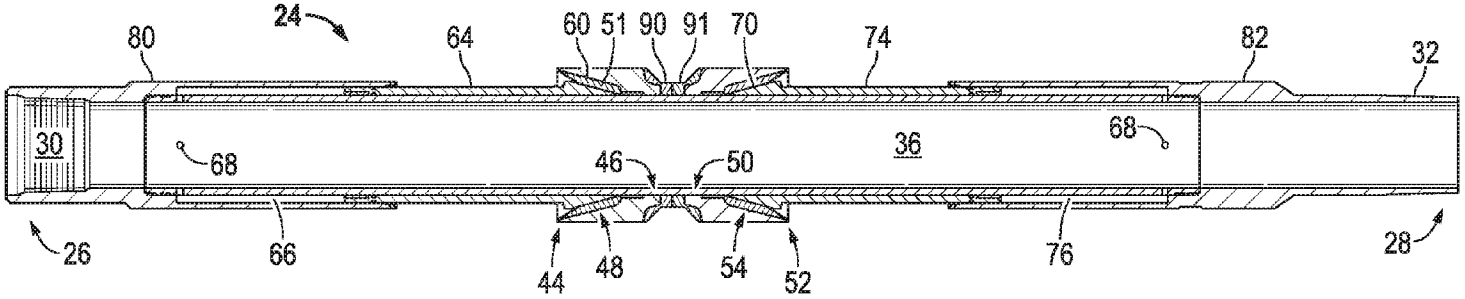
FIG. 4 is a longitudinal cross-sectional view of the sealing element of FIG. 2 as taken along the line 3-3 in a second or expanded position.

Turning to FIGS. 2 through 4, a sealing element 24 according to a first embodiment of the present invention is illustrated. The sealing element 24 is substantially cylindrical shaped extending between first and second ends, 26 and 28, respectively. The first end 26 includes interior threading 30 (not shown in FIG. 2) and the second end 28 includes exterior threading 32 for engagement with and in-line run in with adjacent liner. The sealing element 24 comprises an elongate central tubular member 34 having a central passage 36 therethrough and at least one annular seal member 40 and 42 therearound. The seal members 40 and 42 each corresponding first and second central backing ring 90 and 91 which are located therebetween are each compressible between the backing ring and a longitudinally displaceable wedge 60 and 70 operable to compress and radially expand the annular seal into contact with the surrounding well bore. It will also be appreciated that the backing rings 90 and 91 may be formed of as a single unit.

Figure 8:
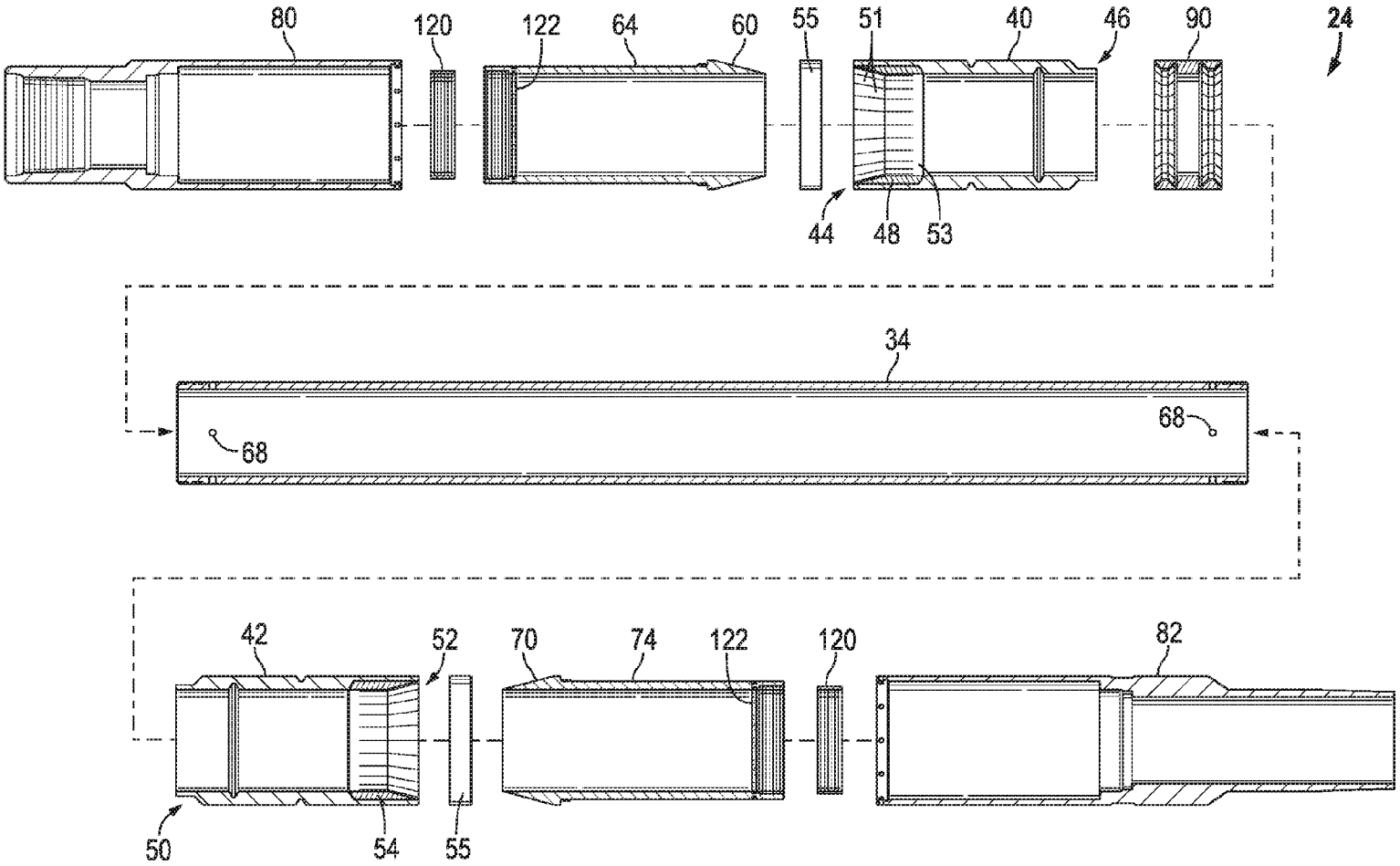
FIG. 8 is an exploded view of the sealing element of FIG. 2.

As illustrated, the sealing element 24 may include first and second seal members 40 and 42, respectively with first and second backing rings, 90 and 91, respectively therebetween. In such an embodiment, the first seal member 40 may be a top seal being disposed towards a top end of the well while the second seal member 42 may be a bottom seal being disposed towards a bottom end of the well. The first seal member 40 comprises a substantially tubular shaped body extending between first and second ends, 44 and 46, respectively. The second end 46 of the first seal member abuts against and engages with the backing ring 90. The first seal member 40 may also be bonded to the first backing ring 90 according to known methods. The first end 44 of the first seal member includes a leading extrusion barrier 48 barrier bonded thereto. The leading extrusion barrier 48 comprises a ring of rigid material extending around the circumference of the first end 44. The extrusion barrier 48 may be segmented or formed of a plurality of independent solid members so as to form an end surface for the first seal member 40. The extrusion barrier 48 may also be formed of a continuous ring 53 with partially independent fingers 51 extending therefrom as illustrated in FIG. 8. In other embodiments, the fingers 51 may be completely independent of each other.

The second seal member 42 comprises a substantially tubular shaped body extending between first and second ends, 50 and 52, respectively. The first end 50 of the first seal member abuts against and engages with the second backing ring 90. The second seal member 42 may also be bonded to the second backing ring 91 according to known methods. The second end 52 of the second seal member includes a trailing extrusion barrier 54 bonded thereto. The trailing extrusion barrier 54 comprises a ring of rigid material extending around the circumference of the second end 52. The trailing extrusion barrier 54 may be segmented or formed of a plurality of independent solid members so as to form an expandable end surface for the second seal member 42.

The first seal member 40 has an associated first wedge 60 associated therewith for compressing and expanding the first seal member 40. The first wedge 60 includes an inclined surface 62 for engagement upon the leading extrusion barrier 48 of the first seal member 40 and an annular piston 64 extending in an opposed direction therefrom. The annular piston 64 extends around the tubular member 34 within an annular void 66 formed between the tubular member and a leading outer sheath 80.

The second seal member 42 has an associated second wedge 70 associated therewith for compressing and expanding the second seal member 42. The second wedge 70 includes an inclined surface 72 for engagement upon the trailing extrusion barrier 54 of the second seal member 42 and an annular piston 74 extending in an opposed direction therefrom. The annular piston 74 extends around the tubular member 34 within an annular void 76 formed between the tubular member and a trailing outer sheath 82.

The first and second seal members 40 and 42 may be formed of any suitable pliable material as are known for use in a down hole environment, such as, by way of non-limiting example, swellable elastomers. The first and second seal members 40 and 42 may have a length selected to provide sufficient radial expansion as described below for the desired application. By way of non-limiting example, the first and second seal members may be selected to have lengths between 6 and 12 inches (152 and 305 mm) although it will be appreciated that other lengths may be useful as well. In particular, it will be appreciated that longer lengths may be utilized for open hole bores whereas shorter lengths may be utilized for sleeved or cased holes. As illustrated, the first and second seal members may have one or more internal or external grooves 39 and 41 therearound so as to facilitate the deformation of the seal members as described below.

The annular voids 66 and 76 are in fluidic communication with the central passage 36 of the tubular member 34 through radial transfer bores 68 extending through the tubular member 34. During operation, a pressurized fluid may be pumped into the central passage 36 and through the radial transfer bores 68 to displace the annular pistons 64 and 74 within the annular voids 66 so as to press the wedges 60 and 70 into the first and second seal member 40 and 40. The wedges 60 and 70 then engage upon the leading and trailing extrusion barriers 48 and 54 of the first and second seal members 40 and 42 so as to axially compress and radially expand the seal members into engagement with the well bore as illustrated in FIG. 4.

Figure 5:
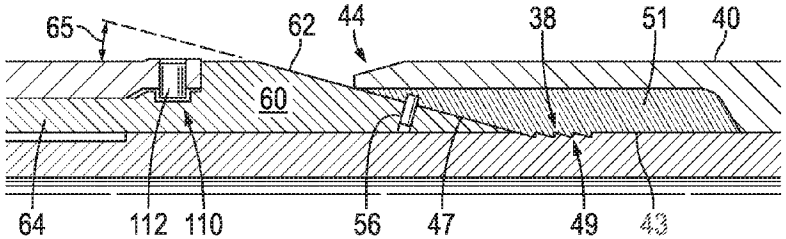
FIG. 5 is a detailed cross-sectional view of the indexing rings of the sealing element of FIG. 2.

Turning to FIG. 5, a detailed view of the first end of the first seal member 40 and the first wedge 60 is illustrated although it will be appreciated that the interaction between the second seal member 42 and the second wedge 70 may be similar. The inclined surface 62 of the first wedge 60 is oriented at an incline angle, generally indicated at 65. The leading extrusion barrier 48 includes an angled surface 47 corresponding to the incline surface 62 of the first wedge 60. The incline angle may be selected to be between 5 and 45 degrees. It will be appreciated that lower incline angles may assist in providing a greater amount of extension force on the first seal member with a reduced distance of extension for a similar length of travel of the wedge 60.

Figure 6:
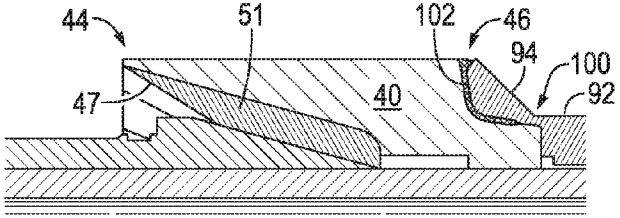
FIG. 6 is a detailed cross-sectional view of an anti expansion device of the control valve of FIG. 2 in a first or retracted position.
Figure 9:
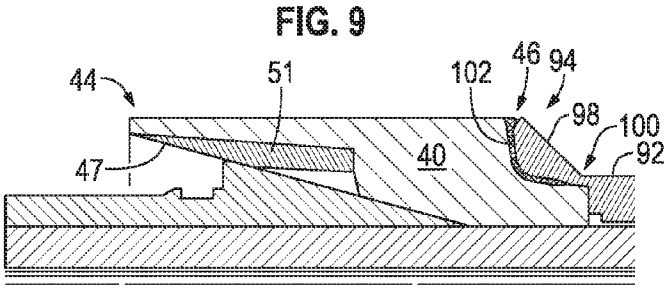
FIG. 9 is a detailed cross-sectional view of an anti-expansion device of the control valve of FIG. 2 in a first or retracted position according to an alternative embodiment of the present invention.

The leading extrusion barrier 48 also includes a plurality of teeth 49 or grooves and ridges located on an inward surface 43 of the leading extrusion barrier. The teeth 49 are engaged in a corresponding set of teeth 38 on an exterior surface of the tubular member 34. In a retracted or run-in position as illustrated in FIG. 5, the teeth 49 on the leading extrusion barrier 48 are engaged within the teeth 38 on the tubular member 34 so as to prevent the any longitudinal movement of the leading extrusion barrier 48 relative and therefore the first seal member 40 to the tubular member during run in of the sealing element. It will be appreciated that preventing any such longitudinal movement will prevent any unwanted activation or expansion of the seal member should the sealing element encounter an obstacle or excessive friction during run-in. During operation, when the sealing element is desired to be expanded, pressing the wedge 60 into the leading barrier lifts the teeth 49 of the leading extrusion barrier 48 out of engagement with the teeth 38 of the tubular member 34 so as to enable the seal member to be compressed and expanded as desired by an operator. As illustrated in FIG. 6, at an extended position, it will be observed that after the wedge 60 has extended the first end 44 of the first seal member 40, the leading extrusion barrier 48 will be exposed to the annulus around the sealing element when the first end 44 is in contact with well bore wall. In such an orientation, the angled surface 47 of the leading extrusion barrier 48 is exposed and presents and angled surface to be engaged by a pressurized fluid surrounding the sealing element 24. Accordingly such a pressurized fluid will exert a longitudinal as well as a radially outward force upon the leading extrusion barrier 48 as well as the first seal member 40 and thereby any pressure exerted upon the sealing element will enhance the seal provided thereby. As illustrated in FIG. 6, each finger 51 of the extrusion barrier 48 may be rotated by the wedge 60 such that the fingers are angularly oriented relative to the central tubular member 34. It will be appreciated that this orientation may be achieved where the fingers 51 are connected to each other by a common ring 53. According to an alternative embodiment, the fingers 51 may each be extended relative to the central tubular member 34 so as to be spaced apart therefrom by the wedge as illustrated in FIG. 9 where the fingers are independent of each other.

The central retaining rings 90 and 91 comprise bodies surrounding the tubular member 34 between the first and second seal members. Each of the first and second retaining rings 90 and 91 comprises a solid portion 92 and either a first and second deformable portion, 94 and 96 respectively disposed towards its respective first or second seal member 40 or 42. The first and second deformable portions 94 and 96 comprise a plurality of longitudinally oriented fingers 98. With reference to one of the fingers of the first deformable portion 94, as illustrated in FIGS. 3, 4 and 6, the fingers 98 may have a substantially triangular cross section having a hinged connection at a second end 100 to the solid portion 92 and a leading edge 102 which is connected to the first seal member 40. The leading edge 102 of the fingers may be connected to the first seal member 40 by adhesives or welding or may be held in a frictional contact therewith. During operation, when the first seal member 40 is pressed towards the retaining ring, the first seal member will bear against the leading edge 102 and rotate the fingers 98 in a radially outward direction as illustrated in FIG. 6 until the second end 46 of the first seal member 40 engages upon the bore wall of the well. In such a position, the first seal member will be sufficiently radially expanded to such a diameter that the first end 44 of the first seal member 40 will also be engaged upon the well bore. It will be appreciated that the length of the fingers 98 will be one factor determining the maximum expansion of the seal member 40. The fingers may have a length any desired length, however it has been found that a length of between 1.5 and 3 inches (38 and 76 mm) has been particularly useful.

As illustrated in the attached figures, a shear ring 110 may be located on each of the first and second wedges 60 and 70. With reference to the first wedge, as illustrated in FIG. 5, the shear ring 110 may be co-formed with the first and second sheaths 80 and 82 or may optionally be secured thereto by fasteners, welding, threading or the like. The shear ring 110 includes a plurality of shear pins 112, which pass through the shear ring 110 and are engaged within the first wedge 60 as are commonly known. The shear pins 112 have a shear force selected by an operator so as to prevent extension of the first wedge 60 until a desired pressure is developed within the central passage 36. In operation, this shear force may be selected to be between 1000 and 3000 psi, although it will be appreciated that other values may be utilized as well. Optionally, the wedge 60 and fingers 51 may include similar shear pins for maintaining the fingers and the sealing members in a retracted position until desired to be opened by an operator.

Figure 7:
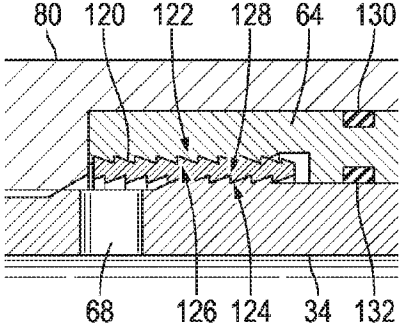
FIG. 7 is a detailed cross-sectional view of an anti expansion device of the control valve of FIG. 2 in a second or extended position.

Turning now to FIG. 7, a detailed view of the end of the annular piston 64 and the transfer bores 68 is illustrated showing an optional ratchet ring 120 between the annular piston 64 and the tubular member. The ratchet ring 120 comprises a cylindrical member having a slot or longitudinal gap therein and having threading or grooves and notches on both the exterior and interior surfaces thereof, 122 and 124 respectively. The inner surface of the annular piston 64 includes corresponding threading or grooves and notches, 126 and 128, respectively. As illustrated in FIG. 7, the threading on the ratchet ring 120 may have a substantially triangular cross-section so as to have a substantially perpendicular face oriented towards the retracted position of the annular piston 64. In such an arrangement, the threading 122 and 124 of the ratcheting ring 120 will assist in retaining the annular piston 64 in an extended position as illustrated in FIGS. 4 and 6. As illustrated in FIG. 7, the annular piston 64 may also includes seals 130 and 132 located therearound so as to seal the connection between the annular piston 64 and the tubular member 34 and sheath 80.

With reference to FIG. 8, the sealing element 24 may be assembled by locating a common backing ring 90 which may be a single or split ring design, over the tubular member 34 at a central portion thereof. The common backing ring 90 may be secured to the tubular member 34 by any known means, such as, by way of non-limiting example, welding, adhesives, threading or the like. Thereafter, the first and second seal members 40 and 42 may be located over the tubular member and abutted against the backing ring 90 and the first and second wedges 60 and 70 located over the tubular member 34 against their respective first and second seal members. The ratchet rings 120 may thereafter be inserted between the annular pistons 64 and 74 of the first and second wedges and the tubular member 34 and the annular pistons covered by the first and second sheaths 80 and 82. It will be appreciated that in some embodiments, only one of the first or second seal member may be utilized with the other seal member, wedge and ratchet ring being omitted.

Optionally, where the backing rings 90 and 91 are bonded to the seal members 40 and 42, the sealing element 24 may be formed by slidably locating the first and second seal members 40 and 42 with their bonded backing rings 90 and 91 and leading and trailing extrusion barriers 48 and 54 and over the tubular member 34 until the first and second backing rings 90 and 91 are abutted against each other. Optionally, the first and second backing rings may be threaded onto the tubular member 34. Thereafter the pistons 64 and 74 may be slidably located to either end of the seal members 40 and 42 with the first and second wedges 60 and 70 in contact with the leading and trailing extrusion barriers 48 and 54. The ratchet rings 120 may thereafter be inserted between the annular pistons 64 and 74 of the first and second wedges and the tubular member 34 and the annular pistons covered by the first and second sheaths 80 and 82. Thereafter the apparatus may be utilized as set out above within a liner string.

Figure 11:
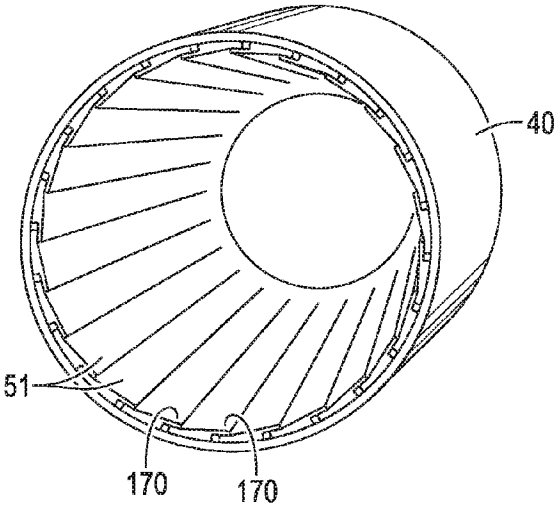
FIG. 11 is and end view of the extrusion barrier of the apparatus of FIG. 1 according to an alternative embodiment of the present invention.
Figure 10:
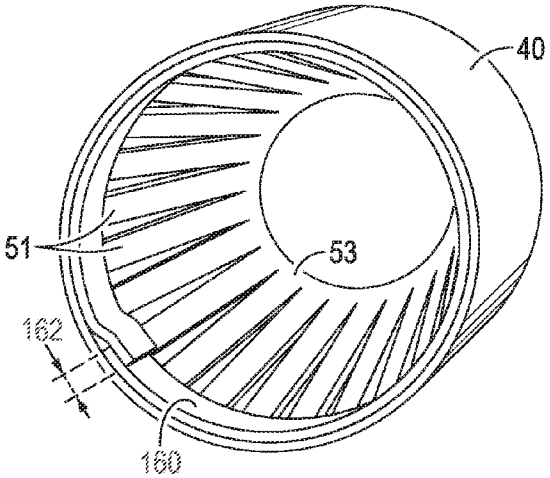
FIG. 10 is and end view of the extrusion barrier of the apparatus of FIG. 1 according to an alternative embodiment of the present invention.

With reference to FIG. 10, optionally, the extrusion barrier 48 may include a continuous expandable ring 55 applied thereto so as to provide a continuous expandable inner surface as illustrated in FIG. 8. The continuous expandable ring may comprise a radially expandable retaining ring 160, having an overlap portion 162, such as a retaining ring manufactured by Spirolox®. Optionally, each finger 51 may include a plate 170 extending therefrom so as to extend over an adjacent finger so as to provide a continuous inner surface as illustrated in FIG. 11.

While specific embodiments of the invention have been described and illustrated, such embodiments should be considered illustrative of the invention only and not as limiting the invention as construed in accordance with the accompanying claims.

What is claimed is:

1. An apparatus for sealing against a bore in a soil formation comprising:

an elongate central member;

a resilient tubular seal member surrounding said elongate central member and extending between first and second ends;

a longitudinally moveable plunger surrounding said central member and having a first wedge engagable upon said first end of said seal member; and a backing ring engaging upon said second end of said seal member, wherein the plunger is axially movable along said central member to compress said seal member between the plunger and said backing ring and to press said first end of said seal member in a radially outward direction;

wherein said seal member includes a metallic inelastic ring disposed at the first end thereof corresponding to said plunger, said inelastic ring being formed of a plurality of segmented fingers.

2. The apparatus of claim 1 wherein said plunger is movable along said elongate member by an actuator.

3. The apparatus of claim 2 wherein said actuator comprises a piston.

4. The apparatus of claim 3 wherein said piston is co-formed with said plunger.

5. The apparatus of claim 3 wherein said piston annularly surrounds said central member.

6. The apparatus of claim 3 wherein said piston is actuated by a fluid supplied from an interior of said central member.

7. The apparatus of claim 1 wherein said plurality of segmented fingers include at least one expandable spanning member spanning therebetween.

8. The apparatus of claim 7 wherein said at least one expandable spanning member comprises a radially expandable retaining ring.

9. The apparatus of claim 7 wherein said at least one expandable spanning member comprises at least one flanges extending from each finger, adapted to overly an adjacent finger.

10. The apparatus of claim 1 wherein said inelastic ring includes an angled leading surface corresponding to said first wedge of said plunger.

11. The apparatus of claim 1 wherein said inelastic ring radially inwardly bear against said central member.

12. The apparatus of claim 11 wherein said inelastic ring is selectably disengagable from said central member by said plunger wedging therebetween.

13. An apparatus for sealing against a bore in a soil formation comprising:

an elongate central member;

a resilient tubular seal member surrounding said elongate central member and extending between first and second ends;

a longitudinally moveable plunger surrounding said central member and having a first wedge engagable upon said first end of said seal member; and a backing ring engaging upon said second end of said seal member, wherein the plunger is axially movable along said central member to compress said seal member between the plunger and said backing ring and to press said first end of said seal member in a radially outward direction, wherein said seal member includes an inelastic ring formed of metal disposed at the first end thereof corresponding to said plunger, wherein said inelastic ring is frangibley connected to said plunger.

14. The apparatus of claim 13 wherein said inelastic ring is frangibley connected to said plunger by shear pins.

15. An apparatus for sealing against a bore in a soil formation comprising:

an elongate central member;

a resilient tubular seal member surrounding said elongate central member and extending between first and second ends;

a longitudinally moveable plunger surrounding said central member and having a first wedge engagable upon said first end of said seal member; and a backing ring engaging upon said second end of said seal member, wherein the plunger is axially movable along said central member to compress said seal member between the plunger and said backing ring and to press said first end of said seal member in a radially outward direction;

first and second seal members being disposed in opposed directions from each other having said backing ring disposed therebetween; and a check valve extending through said backing ring to relieve pressure between said first and second seal members and between said backing ring and said bore.

16. A method for sealing a pipe against a bore in a soil formation comprising:

locating a resilient tubular seal member extending between first and second ends around the pipe at a desired location in the soil formation;

axially moving a plunger surrounding the central member towards a corresponding backing ring with the seal member therebetween so as to compress the seal member between plunger and the packing ring and to press the first end of the seal member in a radially outward direction, wherein said seal member includes a metallic inelastic ring disposed at the first end thereof corresponding to said plunger, said inelastic ring being formed of a plurality of segmented fingers.

* * * * *